US007559614B2

(12) United States Patent
Zheng

(10) Patent No.: US 7,559,614 B2
(45) Date of Patent: Jul. 14, 2009

(54) TOOL CABINET

(75) Inventor: Ying Zheng, Zhejiang (CN)

(73) Assignee: Meridian LM Manufacturing Co., Ltd., ZheJiang (CN)

( * ) Notice: Subject to any disclaimer, the term of this patent is extended or adjusted under 35 U.S.C. 154(b) by 374 days.

(21) Appl. No.: 11/480,861

(22) Filed: Jul. 6, 2006

(65) Prior Publication Data

US 2007/0007867 A1 Jan. 11, 2007

(30) Foreign Application Priority Data

Jul. 8, 2005 (CN) ..... 2005 1 0050646

(51) Int. Cl.
*A47B 47/00* (2006.01)

(52) U.S. Cl. ..... 312/258; 312/238

(58) Field of Classification Search ..... 312/258, 312/262, 257.1, 263, 238, 140.2; 108/115; 220/4.28, 4.31, 4.32, 6
See application file for complete search history.

(56) References Cited

U.S. PATENT DOCUMENTS

| | | | | | |
|---|---|---|---|---|---|
| 168,879 | A * | 10/1875 | Colbert | 312/240 |
| 424,416 | A * | 3/1890 | Graham | 312/262 |
| 1,053,384 | A * | 2/1913 | Harlan | 312/304 |
| 1,756,984 | A * | 5/1930 | Mason | 312/107 |
| 2,028,058 | A * | 1/1936 | Geyer | 220/688 |
| 2,357,309 | A * | 9/1944 | Brown et al. | 206/279 |
| D141,017 | S * | 4/1945 | Stanitz | D6/511 |
| 2,515,876 | A * | 7/1950 | Kauffman | 312/241 |
| 2,778,034 | A * | 1/1957 | Smith | 5/2.1 |
| 3,065,038 | A * | 11/1962 | Pipe | 312/263 |
| 3,160,453 | A * | 12/1964 | Tassell | 312/238 |
| 3,186,782 | A * | 6/1965 | Ullman, Jr. | 312/263 |
| 4,348,069 | A * | 9/1982 | Lindsay | 312/324 |
| 5,405,192 | A * | 4/1995 | McGrath | 312/108 |
| 5,474,196 | A * | 12/1995 | Fausel et al. | 220/4.28 |
| 6,592,025 | B2 * | 7/2003 | Bazany et al. | 229/199 |
| 7,055,833 | B2 * | 6/2006 | Wixted et al. | 280/47.34 |
| 2007/0210682 | A1 * | 9/2007 | Wise | 312/108 |

FOREIGN PATENT DOCUMENTS

JP 08117039 * 10/1994

* cited by examiner

*Primary Examiner*—Janet M Wilkens
(74) *Attorney, Agent, or Firm*—James C. Nemmers

(57) ABSTRACT

A tool cabinet including an upper cover, a bottom board, a case body and a shelf accessory. The case body includes rotatably interconnected case boards, which are foldable with each other. The upper cover and the bottom board are loosely rabbeted into the case body. Without disconnecting each case board, each case board can be folded by pulling out a pin in the upper cover, turning over the upper cover, then taking out the shelf and the upright column, releasing the block rabbeting, and folding the case boards.

14 Claims, 19 Drawing Sheets

TOOL CABINET

CROSS-REFERENCE TO RELATED APPLICATIONS

The present application claims priority under 35 USC 119 to Chinese Patent Application No. 2005-10050646.1 filed on Jul. 8, 2005 the entire contents of which are hereby incorporated by reference.

FIELD OF THE INVENTION

The present invention relates to a tool cabinet, especially a tool cabinet that can be folded and assembled conveniently with pin joint member loosely interconnecting each face board.

DESCRIPTION OF BACKGROUND ART

A tool cabinet is mainly used for uniform management of materials in all trades. The main structure of the conventional tool cabinet is typically one whole body, which is heavy and not easy to carry. There are complicated structures, such as mosaic assembly type, screw lock type etc, but it is disadvantageous in using tool to disconnect and assemble them. For the assembled tool cabinet of large volume, which is not fit for carrying as a whole, once carrying, it is necessary to disconnect by the aid of tools at first, then reassemble it by tools to the destination. It is fussy and time-consuming. On the other hand, when the tool cabinet is free of use, it will still take much space. Hence, it becomes a new task of design for the current tool cabinet to improve variability of its combined structure and its compatibility with the space.

SUMMARY AND OBJECTS OF THE INVENTION

An object of the invention is to provide a foldable tool cabinet with a simple structure. The tool cabinet can be disconnected and assembled simply and carried conveniently and also can spare much room free of use.

To achieve above-mentioned object, a technical solution of an embodiment of the invention is to provide a tool cabinet including an upper cover, a bottom board and a case body. The case body is composed of loosely interconnected case boards with both the upper cover and the bottom board being loosely connected with the case body.

The case body includes four case boards, that is, one front, one back, one left and one right connecting with each other in turn by hinges. The right board respectively connects with the front on one side and with the back on the other side. The other side of the back board connects with the left, and both the front and the left loosely and rotatably connect with a door board respectively by the hinges. An upright column is set at the junction of the two door boards of the case body, whose upper end and lower end loosely connect with the upper cover and the bottom board respectively.

The upper cover and the bottom board, where two single hems are set, loosely connect with the case body by the rabbeted block; and further through slots are set on the bottom board, corresponding to the hinges.

L-type notches are respectively set on the front board, the back board, the left board and the right board, corresponding to the said single hems of the upper cover and the bottom board. When assembling, it is required to encase the interior hems of the upper cover and the bottom board into the L-type notches respectively.

Slot-type hems are set on both sides of the back board and the left board, while single hems are set on one side of the front board and the left board. It is convenient for hinges to be installed on one hand. In addition, it also provides more reasonable space for each face board to be folded. The states of being folded may provide space for the upright column and its accessories to place.

The upright column is L-type. Corresponding L-type block frames are set on the upper cover and the bottom board in which L-type upright column is set.

As an improvement of the invention, slot-type interior hems are set on the upper cover and the bottom board, corresponding to the door boards, so as to make the tool cabinet more closed and aesthetic when the door boards are closed.

As an improvement of the invention, a shelf is set inside the tool cabinet and several grip blocks are located on the upright column and case boards, corresponding to the shelf. The shelf is reticular and it is enough only to place it into grip blocks when assembling.

As a preferred embodiment of the above-mentioned improvement, several transverse L-type strengthening ribs are set on the front board, the back board, the left board and the right board, which can be used as grip blocks of the shelf at the same time.

As an improvement of the invention, the upper cover loosely and rotatably connects with corresponding side of the right board by the hinges. The improvement can make the upper cover fold up and more convenient for use.

A further improvement, fixed pin components are set on the side of the upper cover opposite to the hinges. A jack is located on the left board, corresponding to the fixed pin components, which makes the connection more stable, that of the upper cover with the front, the back, the left and the right.

The fixed pin components comprise two fixed seats set at inner side of the upper cover on which a locking pin is set. A locating block is set on the locking pin between two fixed seats and a spring is set between the locating block and one of the fixed seats. In addition, a jack is set in the notch of the left board, corresponding to the locking pin. When the upper cover is closed on assembling, the locking pin automatically jumps into the jack of the left board by use of stored power of the spring. An individual only needs to pull out the locking pin when the upper cover needs to open.

The fixed pin components can be achieve in this way. The fixed pin components comprise an elastic lock buckle set on the notch of the left board, trigger piece and lock board located on the elastic lock buckle. The trigger piece is set in the wall board of the notch, and the lock board goes through the wall board of the notch and is encased and locked inversely into the block aperture set in the hem of the upper cover. The lock board can be disengaged with the block aperture when pulled by the trigger piece.

As an improvement of the invention, several tool slots are set at the inner side of door boards, which is used to hold small articles such as tool pieces. Door locks may also be set on the door boards.

The above-mentioned technical solution according to the invention, can realize that the upper cover is turned over and folded to the back or the right board, in the condition that the front, the back, the left, the right board, the upper cover and the door board are not detached. In addition, the front and the door board connected with it are flat folded to the right board, while the left and its other door board are flat folded to the back board, together with the back board horizontally folded to the right board. The process before the fold is to pull the pin of upper cover out, turn the upper cover over, then to take the shelf and the upright column out, after that, to release rabbeting of the bottom board, then to fold the case boards. During disconnecting, it is done that the shelf and the upright column are placed into a predetermined space of the right and the back board. During disconnecting, it is done that the shelf and the upright column are placed into a predetermined space of the right and the back board. It is very simple and convenient for carrying after folded and much space is spared at the same time. The assembly is the inverse process of the folding steps and it is also simple and convenient.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
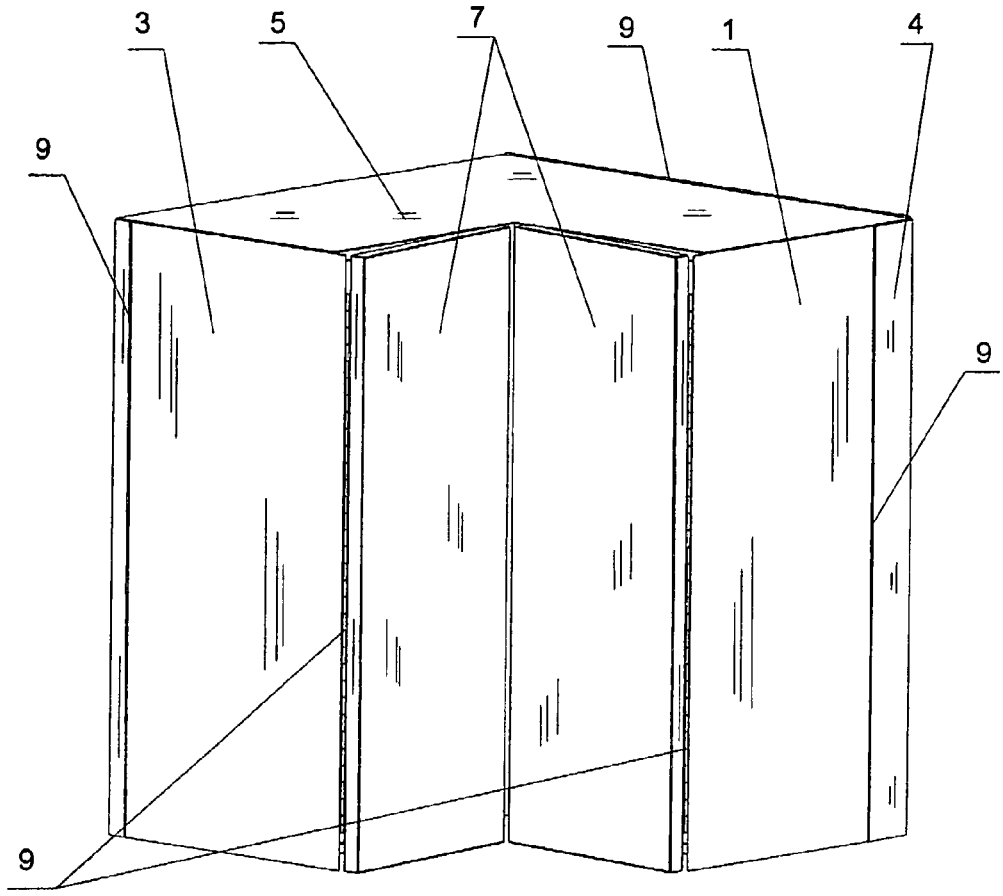
FIG. 1 is schematic view of the combined stereo structure of the invention in the state of the door board closed.
Figure 2:
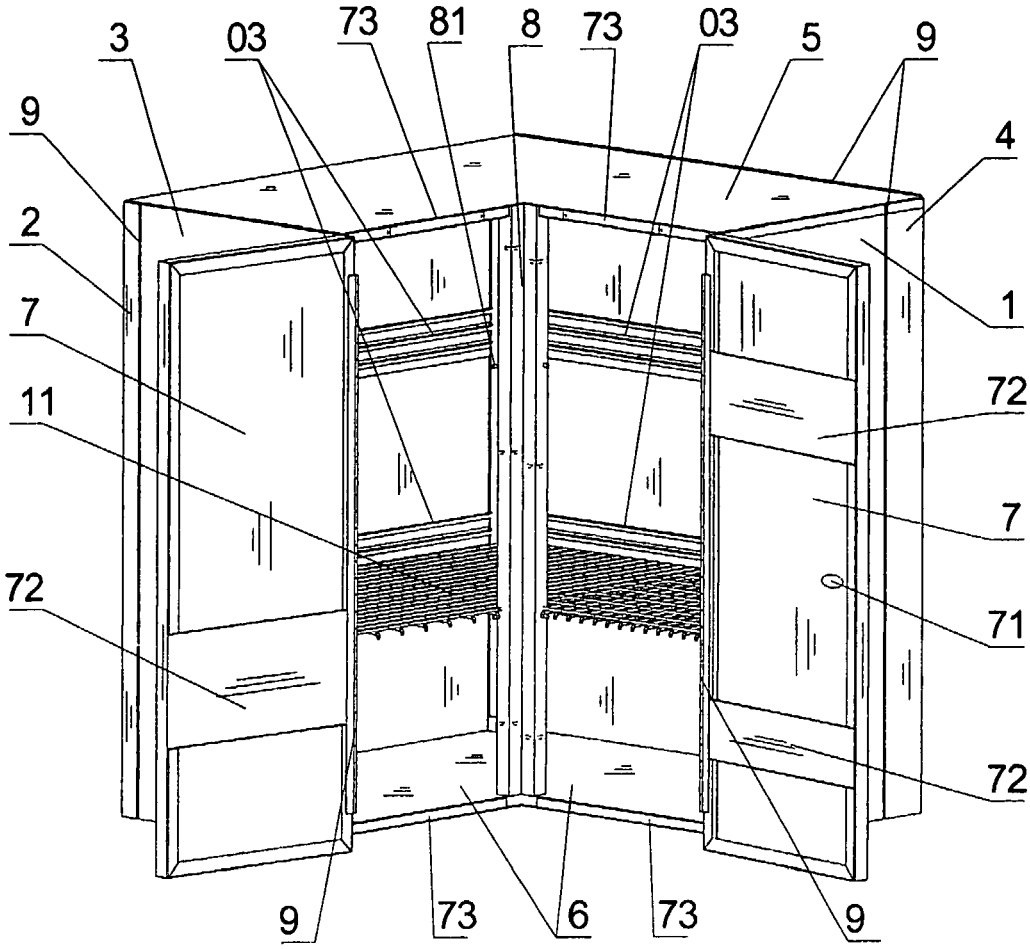
FIG. 2 is schematic view of combined stereo structure of the invention in the state of the door board opened.
Figure 7:
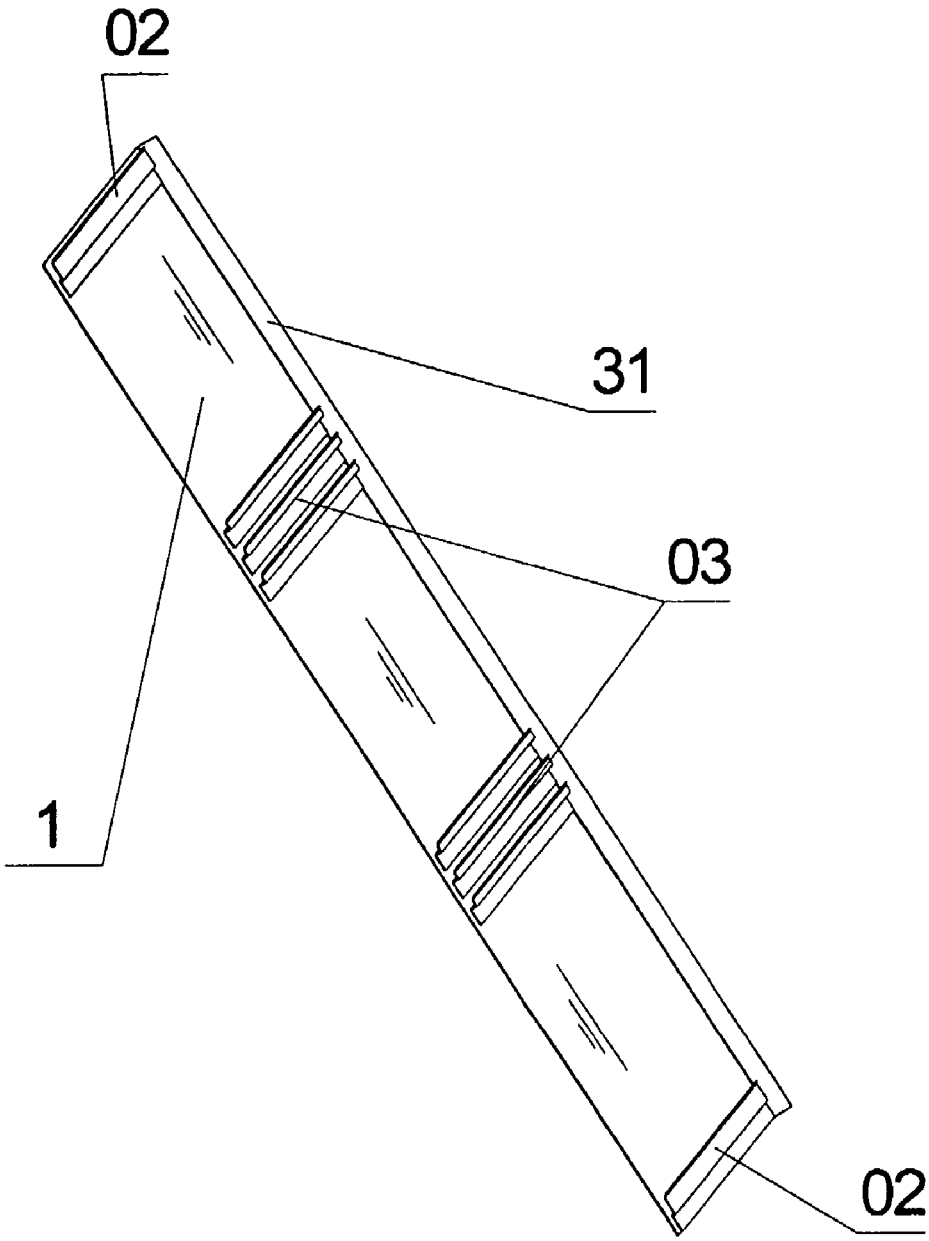
FIG. 7 is schematic view of the structure of the front board (left board) of the invention.
Figure 8:
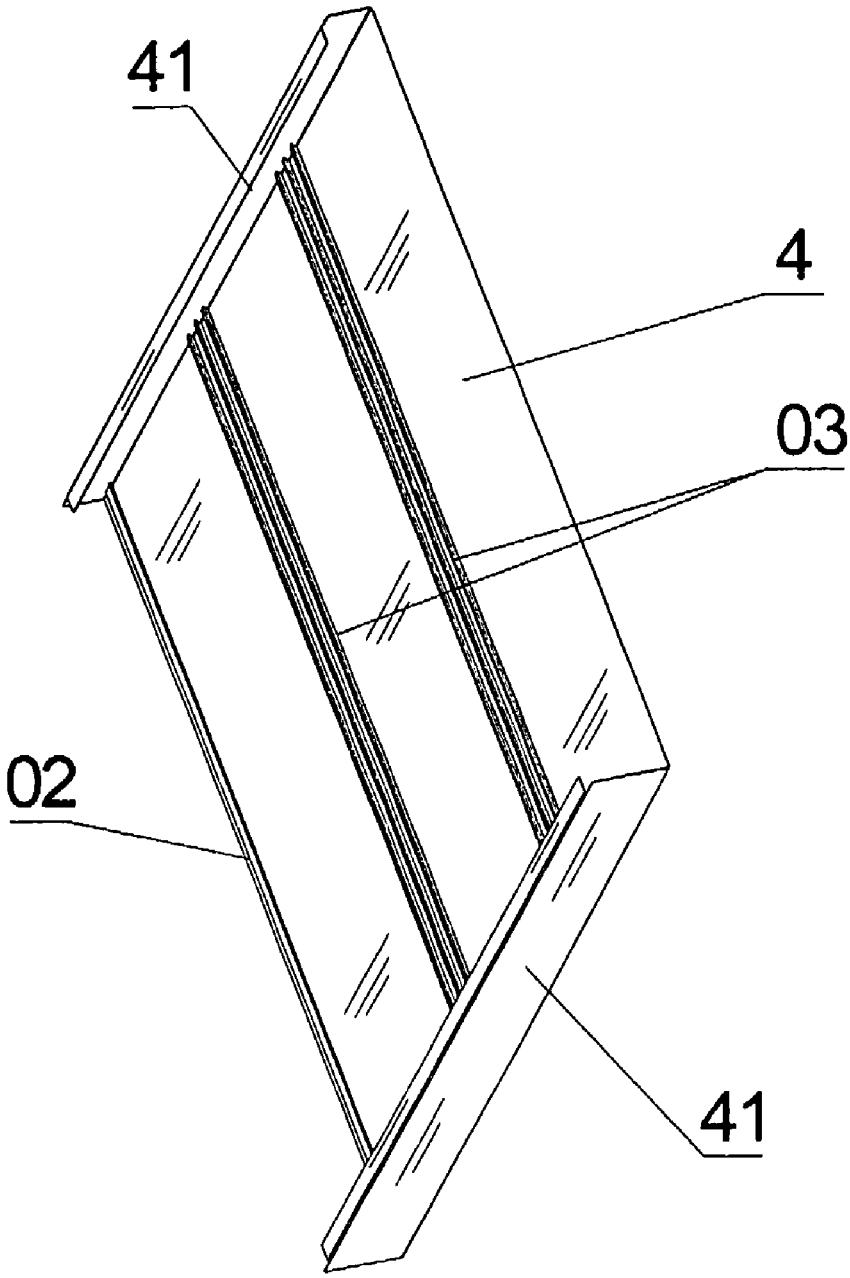
FIG. 8 is schematic view of the structure of the right board (back board) of the invention.

As shown in FIG. 1 and FIG. 2, the tool cabinet according to the embodiment of the invention comprises the front board 1, the back board 2, the left board 3, the right board 4, the upper cover 5, the bottom board 6, the door boards 7, the shelf 11 and the L-type upright column 8. The structure of the front board 1 is the same as that of the left board 3 and the back board 2 and the right board 4. The door lock 71 is set on the door board 7 with several tool slots 72 set at its inner side. One side of the right board 4 loosely and rotatably connects with the front board 1 and with the back board 2 on the other side. The other side of the back board 2 loosely and rotatably connects with the left board 3. The above-mentioned loose connection is inwardly rotatable connection by the hinges 9. As shown in FIG. 7 and FIG. 8, single hems 31 are set on one side of the front board 1 and the left board 3. Slot-type hems 41 are set on the back board 2 and the right board 4. It is convenient to placing hinges 9. On the other hand, it also provides more reasonable space to fold each face board. The state of being folded also may provide space to place the upright column and its other accessories. The front board 1 and the left board 3 loosely and rotatably connected with a door board 7 by the hinges 9 respectively. The upper cover 5 and the bottom board 6 are block rabbeted with the four case boards, such as the front 1, the back 2, the left 3 and the right 4. The L-type upright column 8 is set in L-type block frames 51 and 61 on the upper cover 5 and bottom board 6, which correspond to the column 8.

Figure 3:
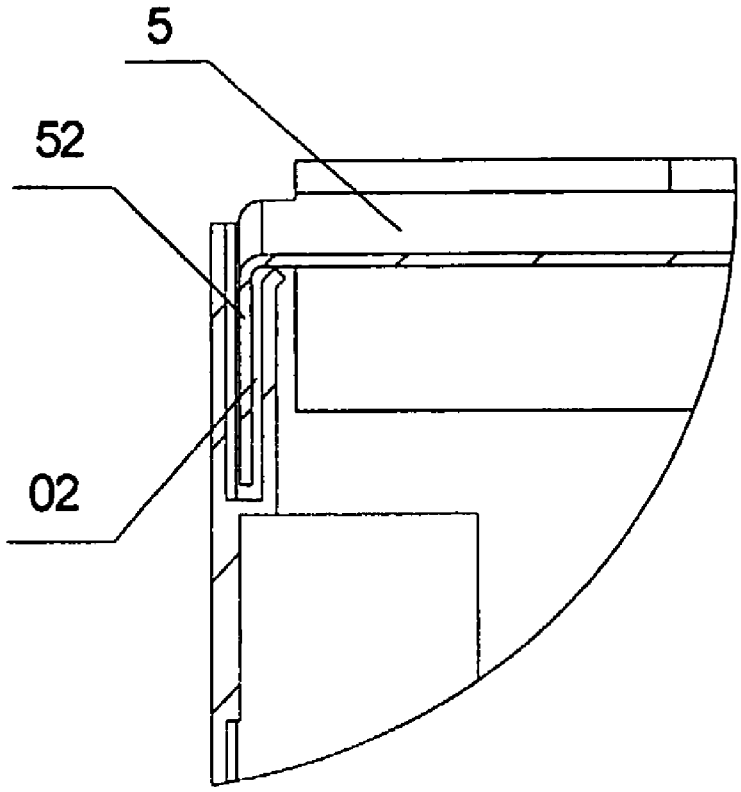
FIG. 3 is schematic view of the rabbeted structure of the upper cover and the case board.
Figure 6:
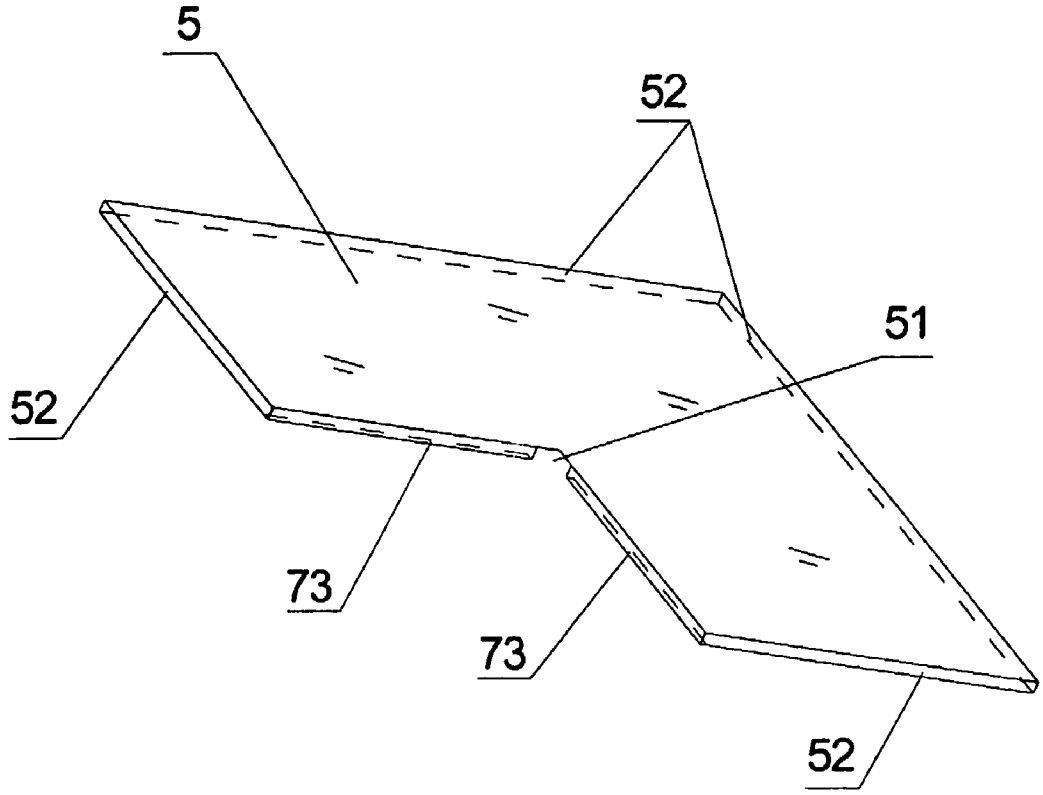
FIG. 6 is schematic view of the structure of the upper cover of the invention.
Figure 9:
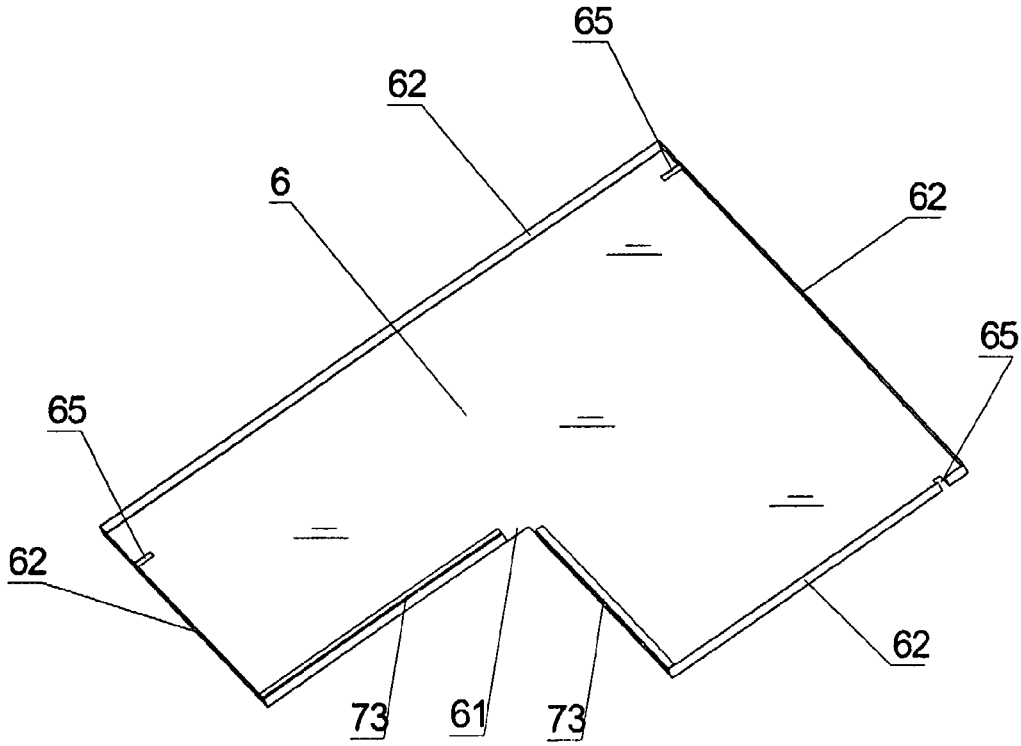
FIG. 9 is schematic view of the structure of the bottom board of the invention.
Figure 10:
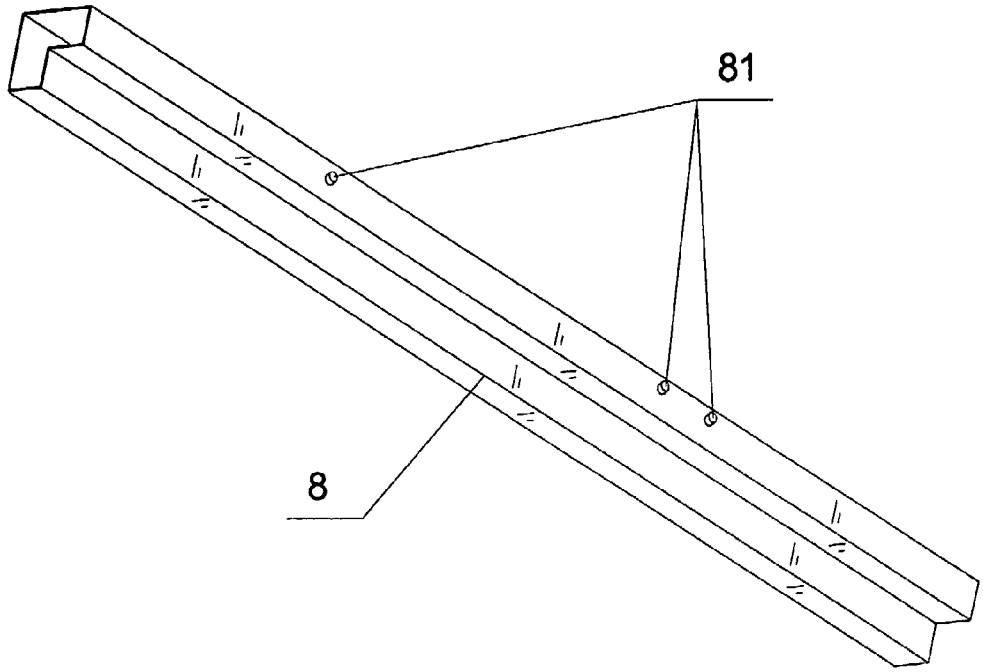
FIG. 10 is schematic view of the structure of the upright column of the invention.
Figure 11:
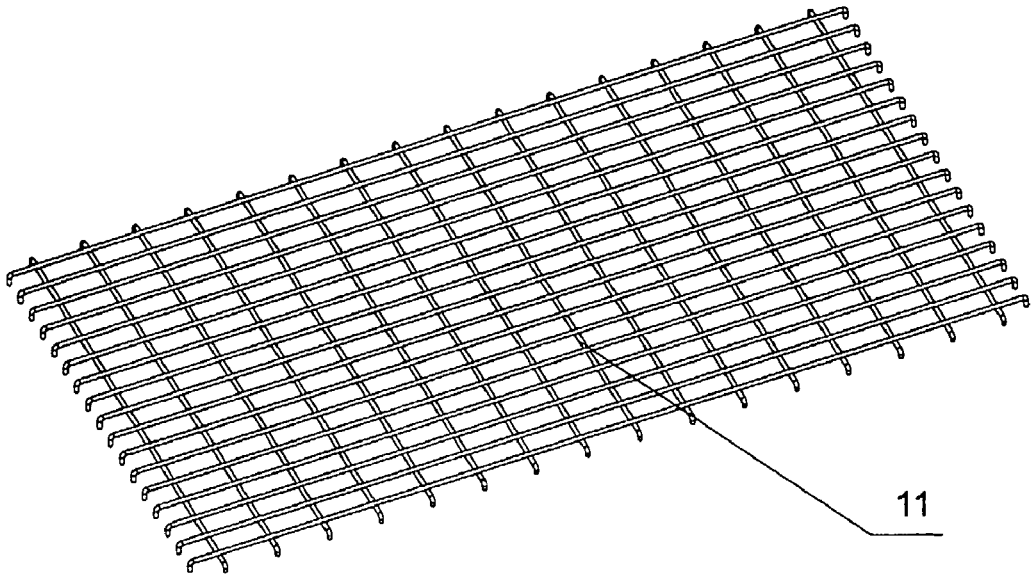
FIG. 11 is schematic view of the structure of the shelf of the invention.

As shown in FIGS. 3, 6 and 9, the block rabbeting mode of the upper cover 5 and the bottom board 6 with the four case boards is as follows. Hems 52, 62 are located on the upper cover 5 and bottom board 6. L-type notches 02 are respectively set on the four case boards, which correspond to the hems 52, 62. When assembling, it is only necessary to encase the hems 52, 62 of the upper cover 5 and the bottom board 6 respectively into the L-type notches 02. On assembling, the bottom board will be embed into the case body, so it is necessary to go through the hinges from upside to downside and through slot 65 should be set on the bottom board so that the hinges put no effect on the assembling of bottom board. Slot-type interior hems 73 are set on the upper cover 5 and bottom board 6, which correspond to the door boards 7, ensuring tool cabinet is more closed and aesthetic when the door boards are closed.

As shown in FIGS. 7, 8, 10 and 11, according to the example, the installment way of the shelf inside the tool cabinet is as follows, several grip blocks 81 are set on the upright column 8 that correspond to the shelf 11. Several transverse L-type strengthening ribs 03 are respectively set on the front board 1, the back board 2, the left board 3 and the right board 4 which can also be used as grip blocks of the shelf at the same time. The shelf 11 is reticular and the grip blocks 81 are L-type. It is enough only to place reticular shelf into grip blocks when assembling.

Figure 4:
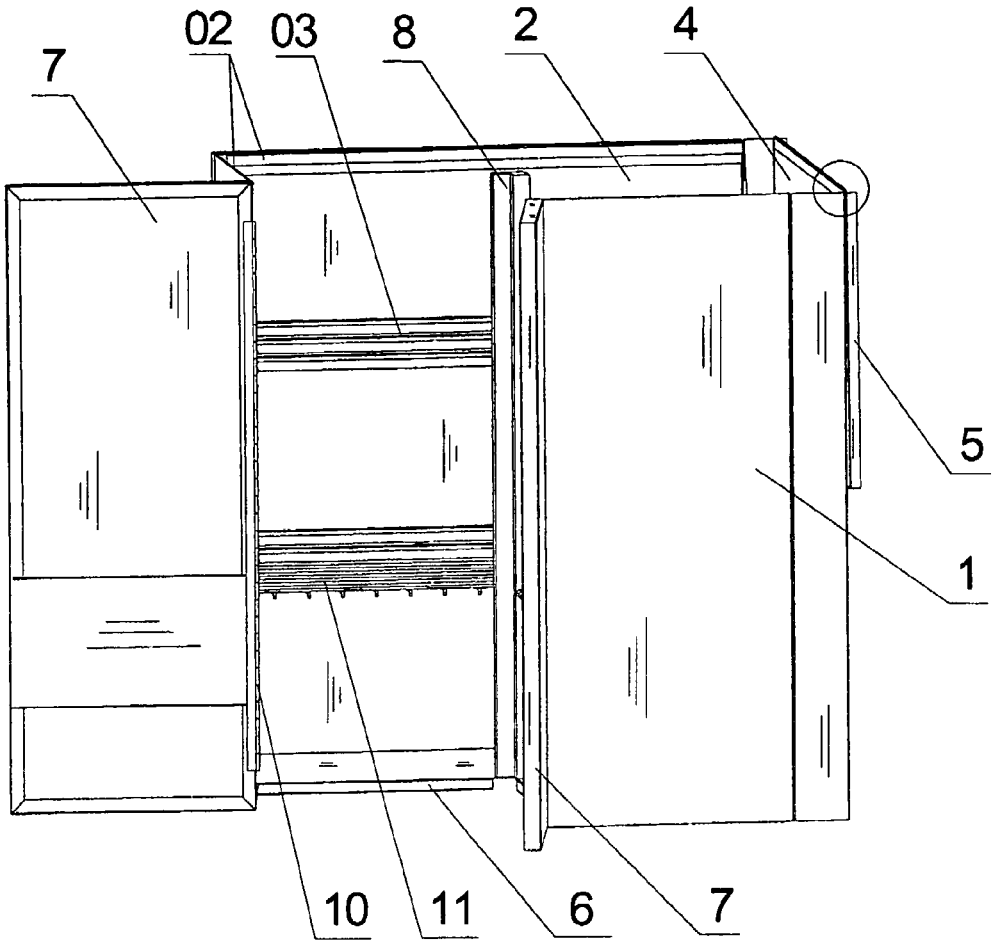
FIG. 4 is schematic view of folding structure of the upper cover loosely connected to the back board in the invention.
Figure 5:
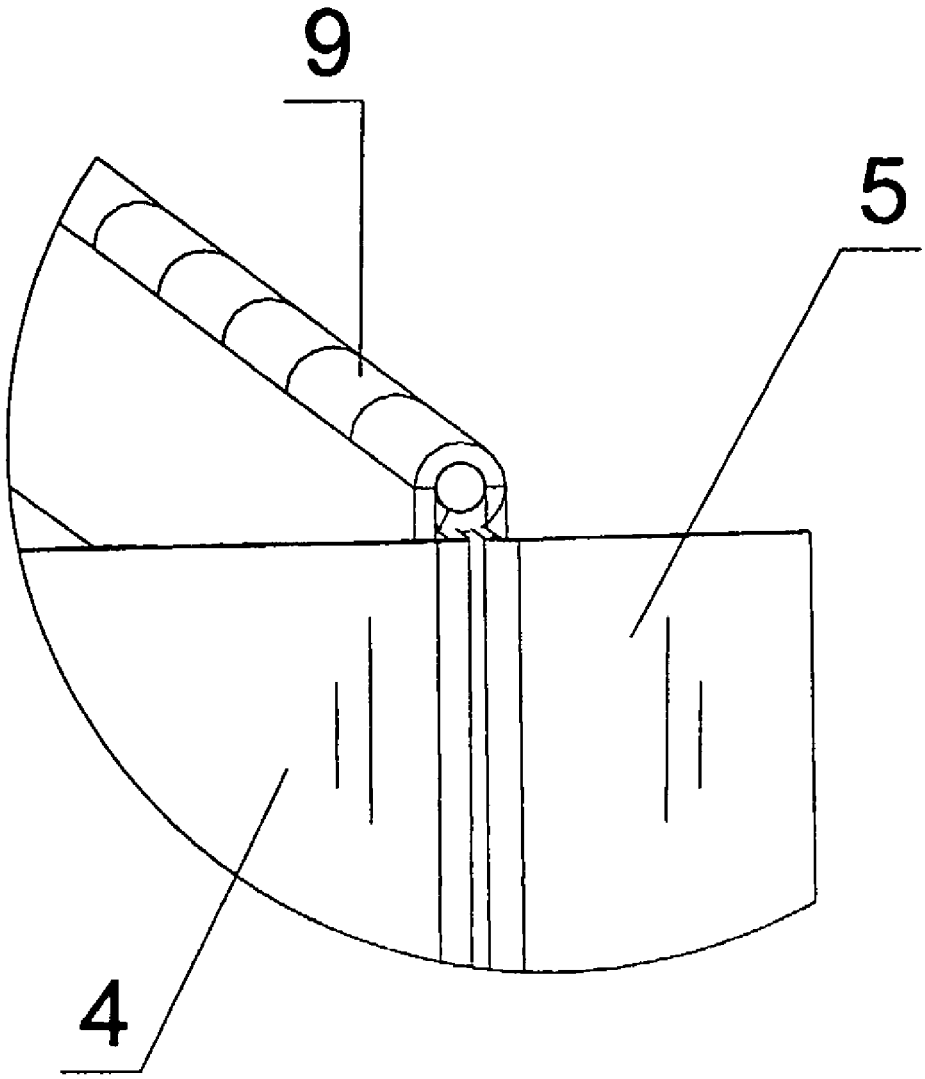
FIG. 5 is enlarged view of part I in FIG. 4.

FIGS. 4 and 5 are the preferred rabbeting mode of the upper cover of the invention. The upper cover 5 outwardly, loosely and rotatably connects with one corresponding side of the right board 4 by the hinges 9. In this way, the upper cover is folded up and it is more convenient. Fixed pin components 53 are set on a corresponding side of the upper cover 5 opposite to the hinges 9. Jacks 04 are set on the left board 3 corresponding to fixed pin components, which make the connection of the upper cover with the four case boards more stable. Alternatively, each side of the upper cover may also loosely, inwardly and rotatably connect with the back board by the hinges 9, and correspondingly, it is necessary to adjust the fixed pin components.

Figure 12:
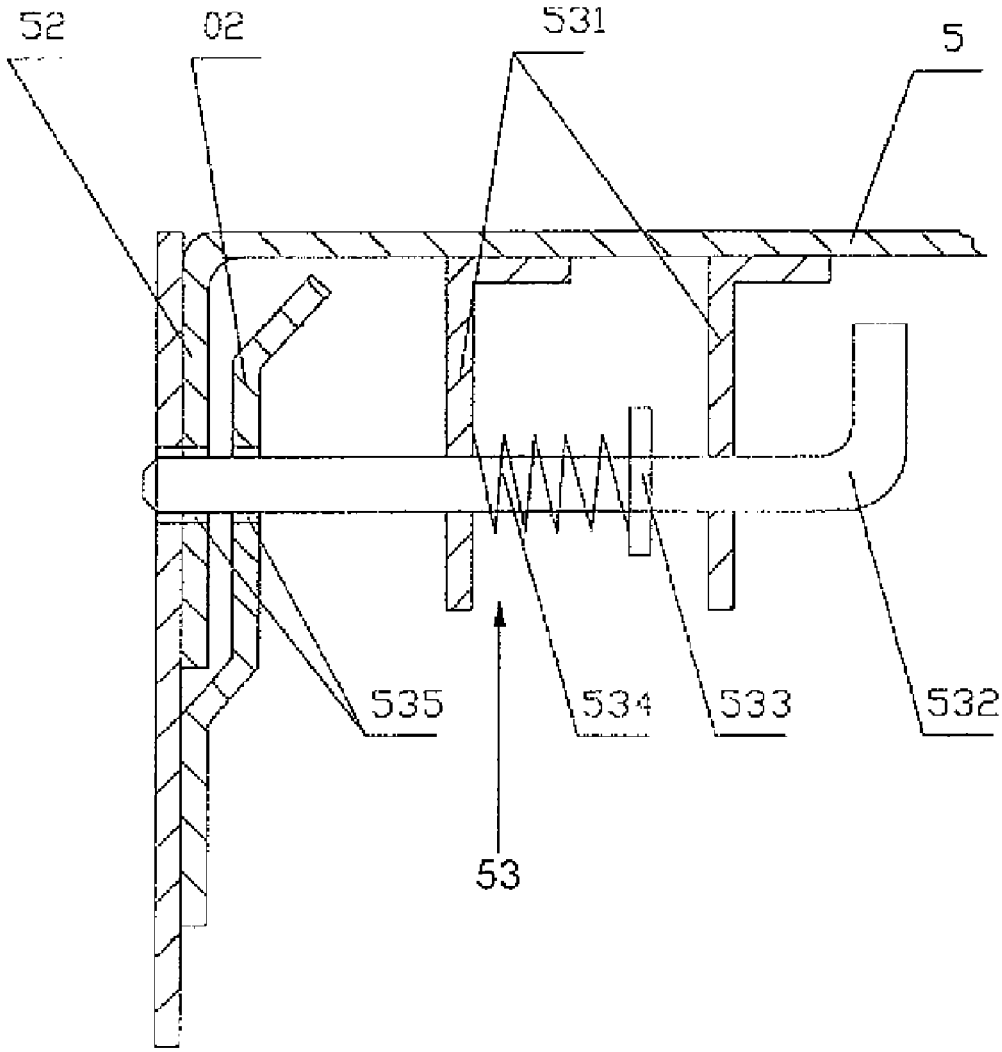
FIG. 12 is schematic view of the structure of the locking pin of the invention.

FIG. 12 is an embodiment of the above-mentioned fixed pin components. The fixed pin components comprise two fixed seats 531 set at inner side of the upper cover and a locking pin 532 set on the seats. A locating block 533 is set on the locking pin between two fixed seats 531 and a spring 534 is located between the locating block and one of the fixed seats. A jack 535 is set in the notch 02 of the left board, corresponding to the locking pin. On assembling, when the upper cover is closed, the locking pin automatically jumps into jack of the left board by using stored power of the spring. In addition, when the upper cover is opened, it is enough only to pull the locking pin out.

Figure 13:
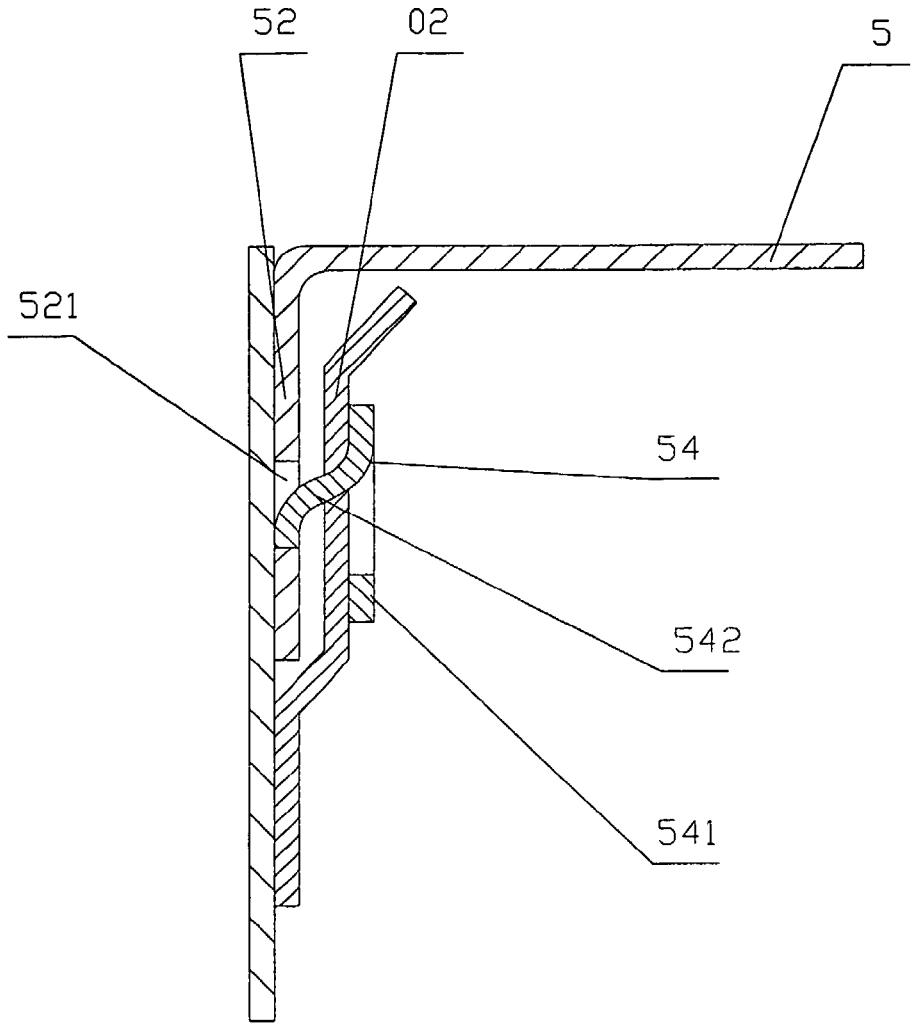
FIG. 13 is schematic view of another structure of the locking pin of the invention; and FIG. 14 to FIG. 19 is schematic view of folding steps of the invention.

FIG. 13 is another embodiment of the fixed pin components. The fixed pin components comprise elastic lock buckle 54 set on the notch 02 of the left board, trigger piece 541 and lock board 542 located in the elastic lock buckle 54. The trigger piece 541 is set on notch 02. The lock board 542 goes through the notch 02 and is encased and locked into the block aperture 521 set in the hem 52 of the upper cover. The locking board 542 can be disengaged with the block aperture 521 when pulled by the trigger piece 541.

Figure 14:
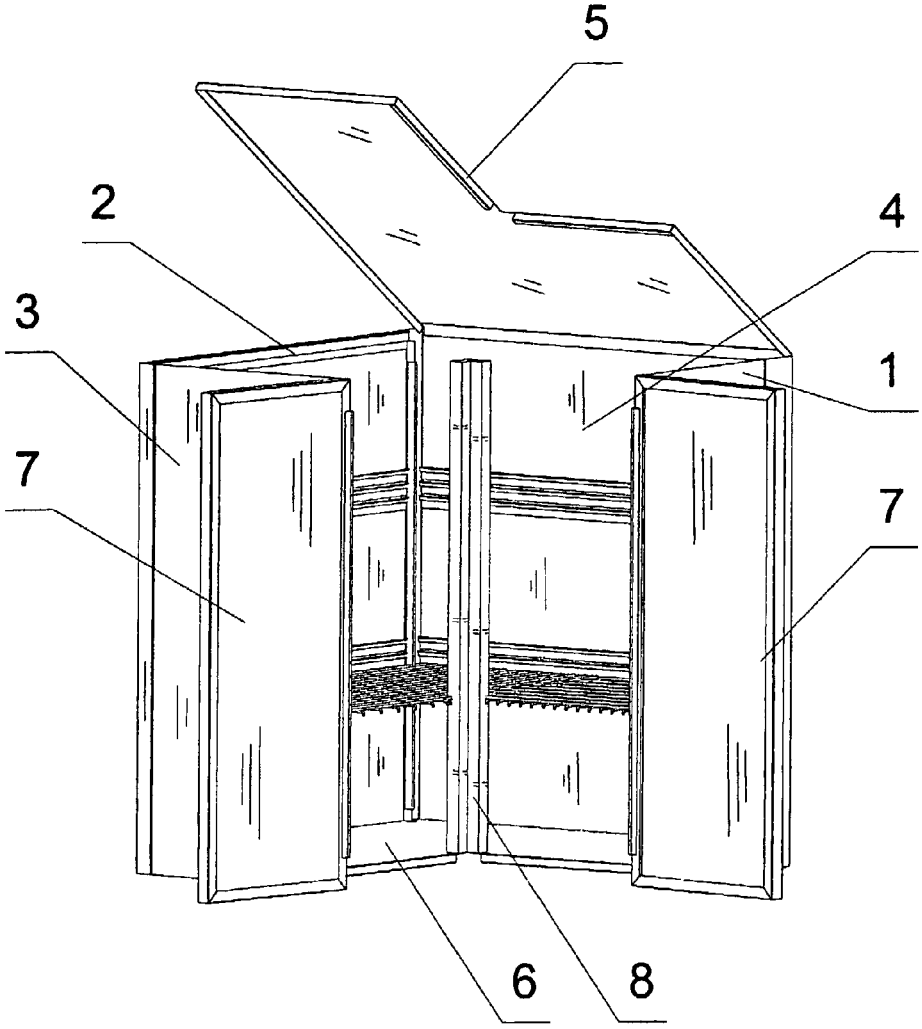
Figure 15:
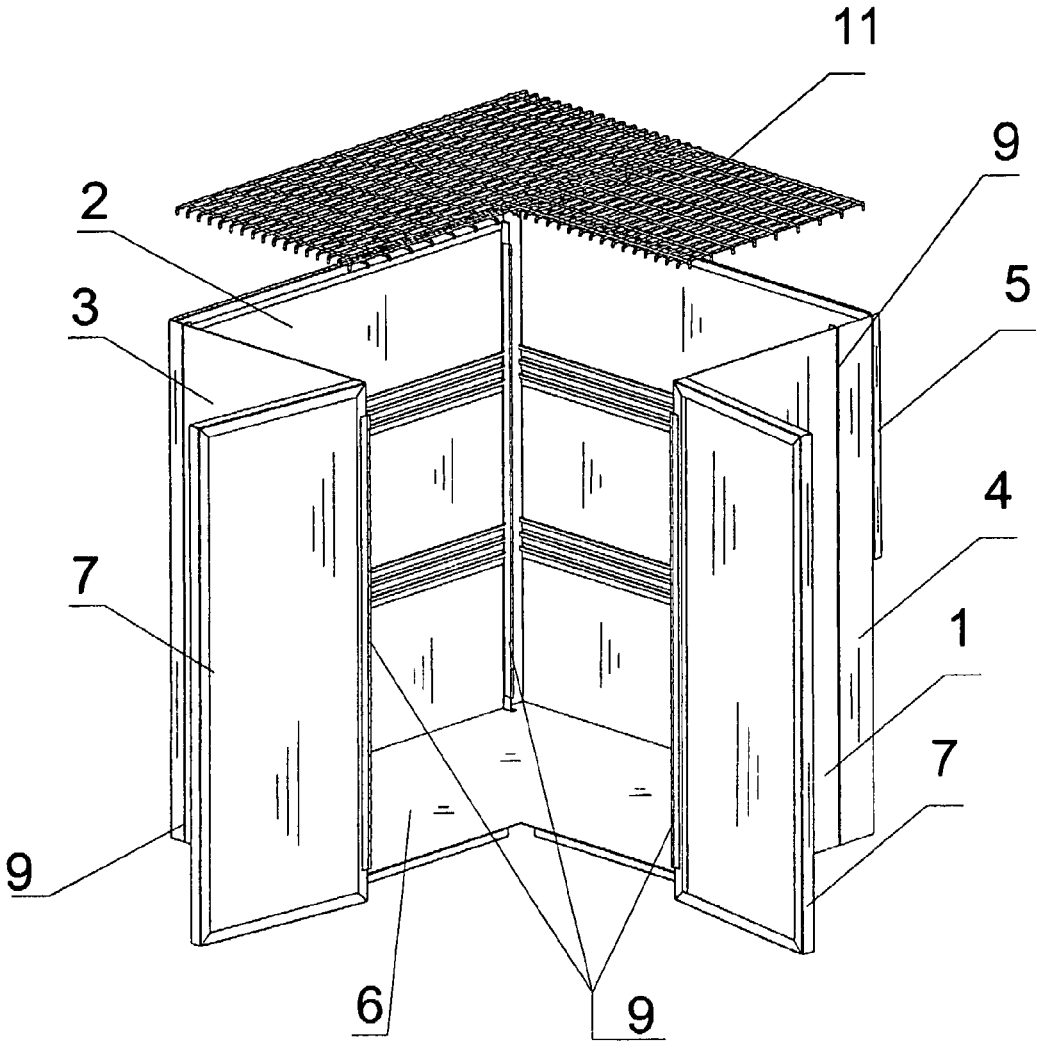
Figure 16:
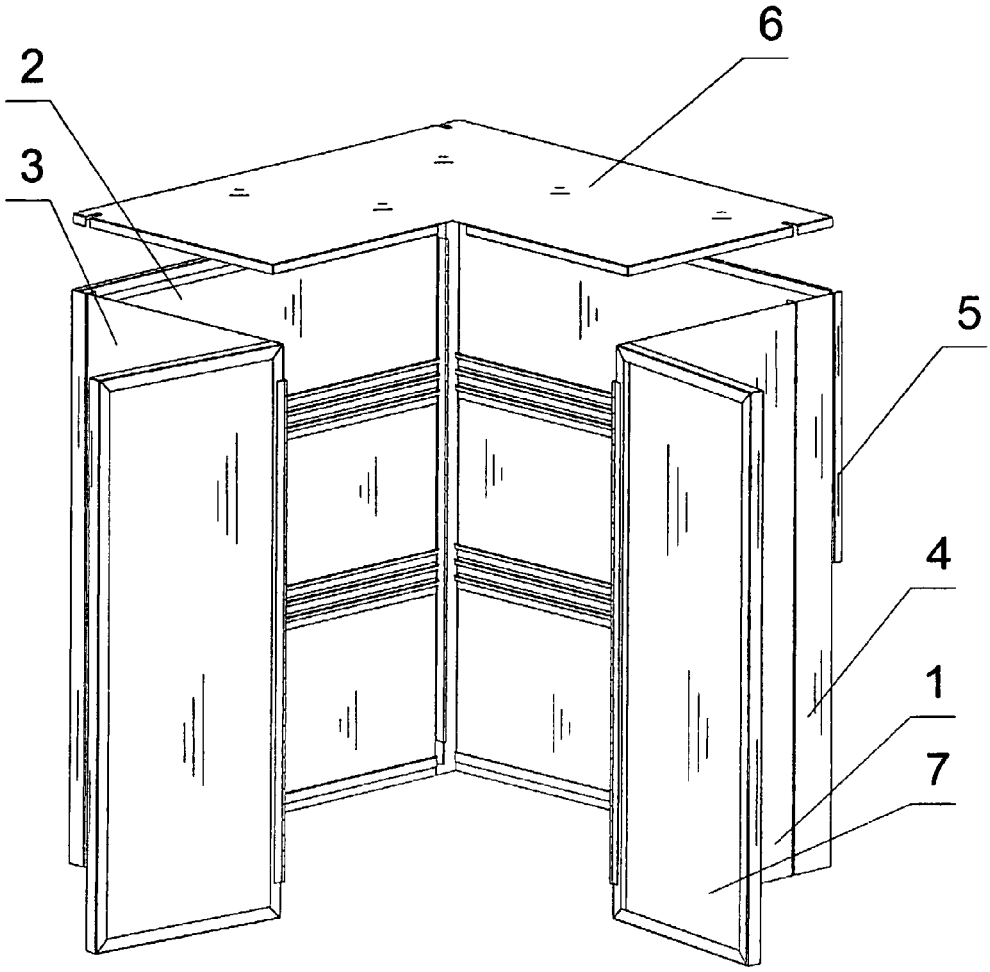
Figure 17:
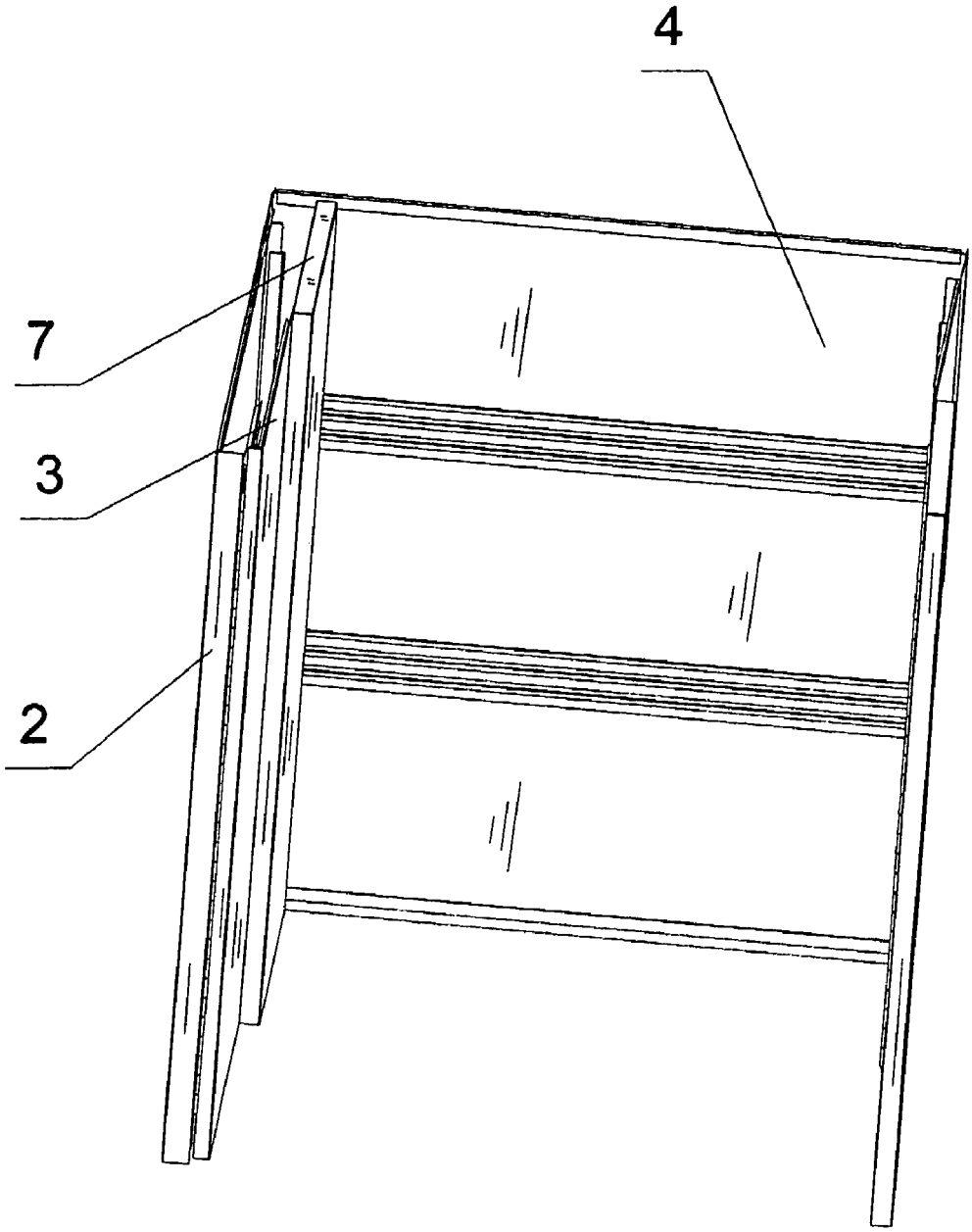
Figure 18:
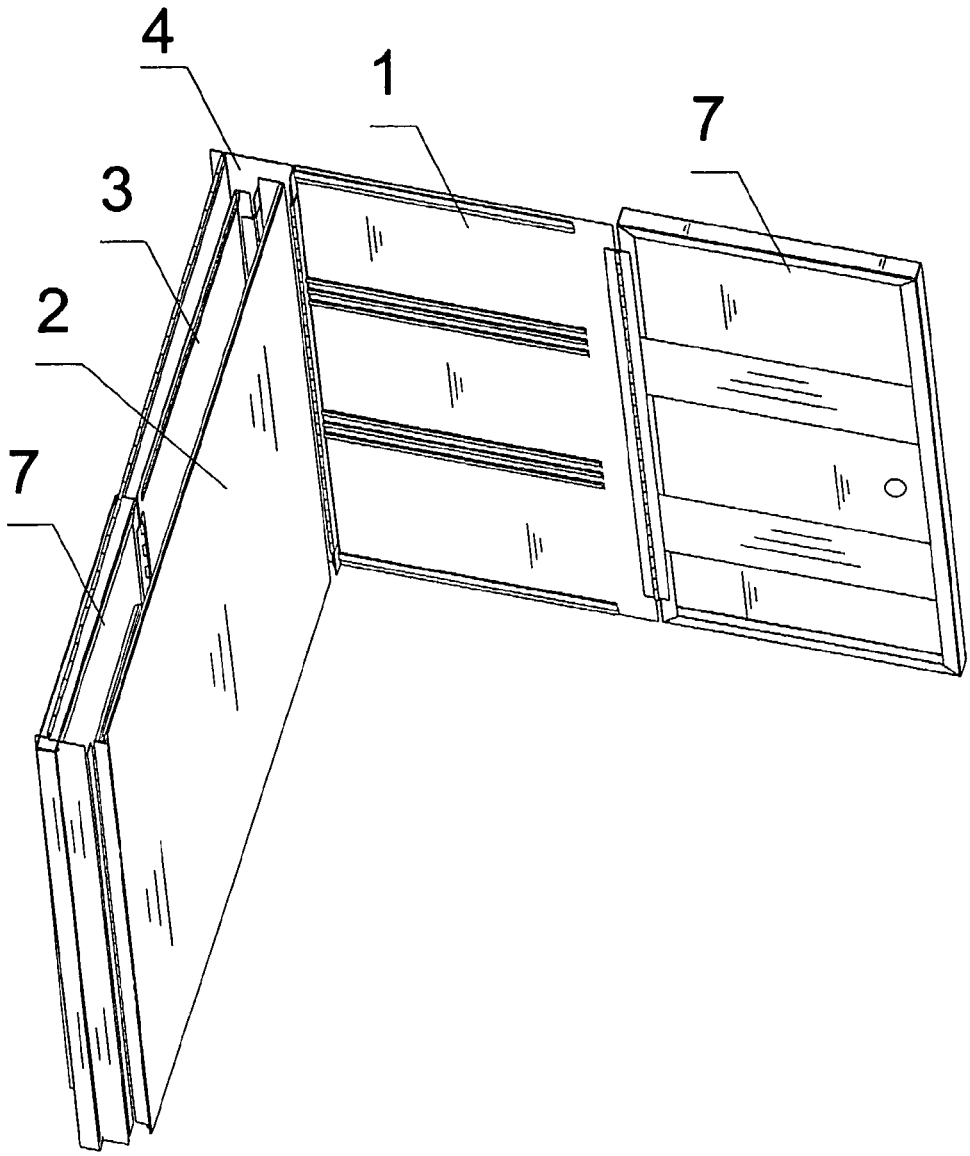
Figure 19:
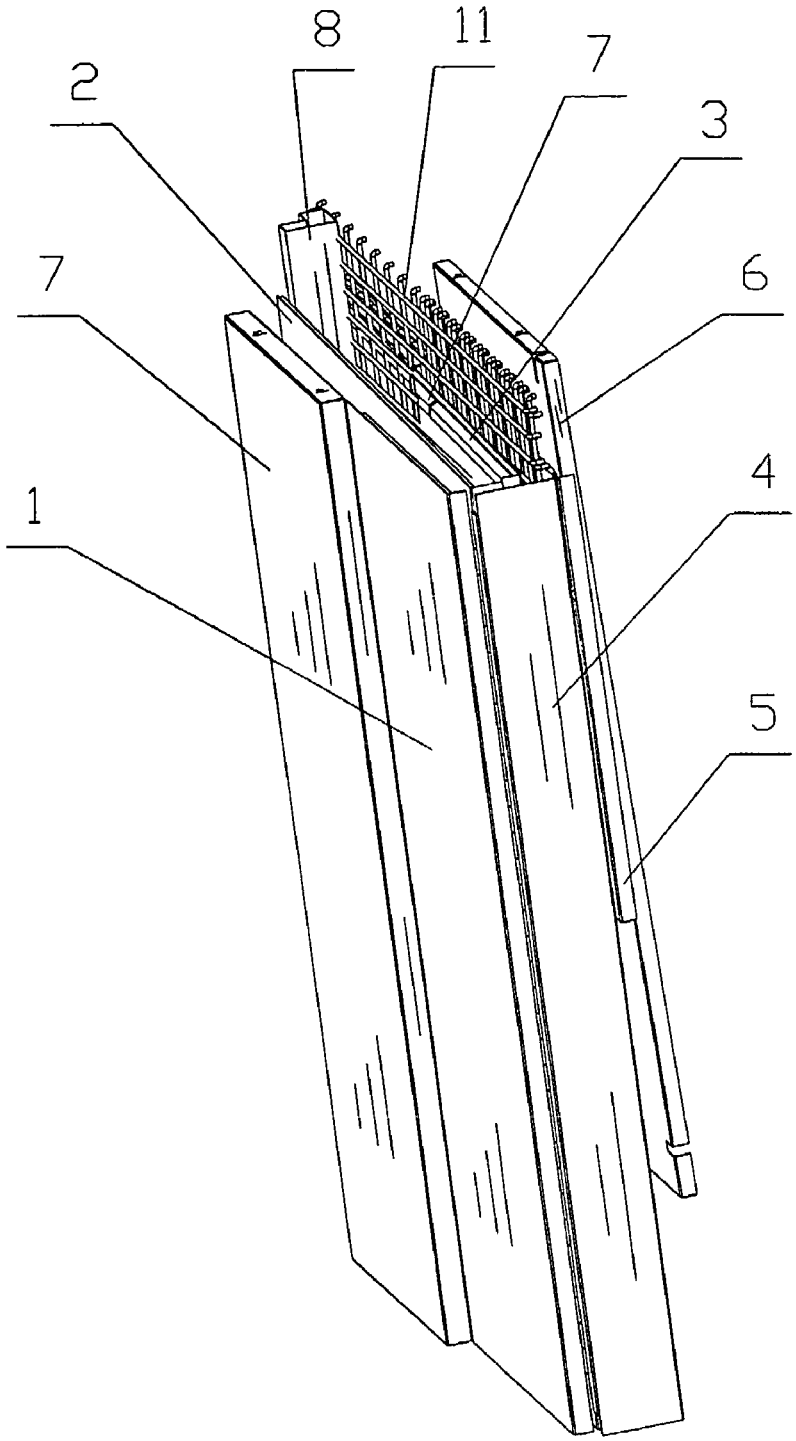

FIGS. 14 to 19 are schematic views of folding steps of the invention. FIG. 14 illustrates a step to release the cover and the board. FIG. 15 illustrates a step to remove the upright column and the shelf. FIG. 16 illustrates a step to release the bottom board. FIG. 17 illustrates a step to flat fold the left board and the door board to the right board. FIG. 18 illustrates a step to flat fold the back board together with the folded door board to right board. FIG. 19 illustrates a step to flat fold the front board and door board to the right board and to place the shelf and the upright column into inner space of the right board and the back board, then the fold of tool cabinet is finished. The assembly of the tool cabinet is an inverse process to the fold steps, so it is also simple and convenient.

In the condition that the front, the back, the left, the right board, the upper cover and the door board are not disconnected, the invention can realize the upper cover is turned over and folded to the back or the right board with the front and the door board connected with it being flat folded to the right board, while the left and its other door board are flat folded to the back board, together with the back board horizontally folded to the right board. The process before the fold is to pull the pin of the upper cover out, turn the upper cover over, then to take the shelf and the upright column out, after that, to release rabbeting of the bottom board, then to fold the case boards. During disconnecting, it is done that the shelf and the upright column are placed into a predetermined space of the right and the back board. It is very simple and convenient for carrying after folded and much space is spared at the same time. The assembly is the inverse process of the folding steps and it is also simple and convenient.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A tool cabinet comprising:

an upper cover;

a bottom board having connecting slots; and a case body comprised of loosely interconnected case boards including a front board, a back board, a right board and a left board connected by hinges that correspond to the slots in the bottom board;

the case body also having rabbeted blocks and the front board, the back board, the left board and the right board having L-type notches;

the upper cover and the bottom board including two single hems that correspond to the L-type notches, thereby loosely connecting the upper cover and the bottom board with the case body by the rabbeted blocks.

2. The tool cabinet according to claim 1, wherein slot-type hems are set on both sides of the back board and the left board, while single hems are set on one side of the front board and the left board.

3. The tool cabinet according to claim 1, wherein the upper cover loosely and rotatably connects with a corresponding side of the right board by the hinges.

4. The tool cabinet according to claim 1 wherein L-type transverse strengthening ribs set on the front board, the back board, the left board and the right board providing grip blocks; and a shelf is set on the grip blocks.

5. The tool cabinet according to claim 4, wherein fixed pin components are set on the side of the upper cover opposite to the hinges and a jack is set on the left board, corresponding to the fixed pin components.

6. A tool cabinet comprising:

an upper cover;

a bottom board;

L-type keeper frames set on the upper cover and bottom board;

a case body comprised of four loosely integrated case boards including, a front board, a back board, a right board and a left board connected with each other in turn by hinges, the right board, respectively, being connected with the front board on one side and with the back board on the other side, the other side of the back board being connected with the left board;

the case body also having two door boards loosely and rotatably connected by hinges to the front board and the left board; and an L-type upright column having an upper end and a lower end loosely connected, respectively, with the upper cover and the bottom board by being set in the L-type keeper frames, the column being set at the juncture of the two door boards of the case body.

7. The tool cabinet according to claim 6 wherein L-type transverse strengthening ribs set on the front board, the back board, the left board and the right board providing grip blocks; and a shelf is set on the grip blocks.

8. The tool cabinet of claim 7 wherein the left board has a notch, and fixed pin components are set on the side of the upper cover opposite to the hinges, the fixed pin components comprising:

two fixed seats set at inner sides of the upper cover on which a locking pin is set;

a locating block set on the locking pin between the two fixed seats;

a spring located between the locating block and one of the fixed seats; and a jack set in the notch of the left board corresponding to the locking pins.

9. The tool cabinet of claim 7 wherein the left board has a notch with a wall board, the upper cover has a hem with a block aperture, and fixed pin components are set on the side of the upper cover opposite to the hinges, the fixed pin components comprising:

an elastic lock buckle set on the notch of the left board; and a trigger piece and a lock board located on the elastic lock buckle, the lock board extending through the wall board of the notch and being encased and locked inversely into the block aperture of the hem of the upper cover, with the lock board being disengaged with the block aperture when pulled by the trigger piece.

10. A tool cabinet comprising:

an upper cover;

a bottom board;

a case body comprised of four loosely integrated case boards including, a front board, a back board, a right board and a Left board connected with each other in turn by hinges, the right board, respectively, being connected with the front board on one side and with the back board on the other side, the other side of the back board being connected with the left board;

the case body also having two door boards loosely and rotatably connected by hinges to the front board and the left board;

an upright column having an upper end and a lower end loosely connected, respectively, with the upper cover and the bottom board, the column being set at the juncture of the two door boards of the case body;

several grip blocks set on the upright column and the case boards; and a shelf inside the tool cabinet is set on the grip blocks.

11. The tool cabinet according to claim 10, wherein door locks and several tool slots are set on inner side of the door boards.

12. A tool cabinet comprising:

an upper cover;

a bottom board; and a case body comprised of four loosely integrated case boards including, a front board, a back board, a right board and a left board connected with each other in turn by hinges, the right board, respectively, being connected with the front board on one side and with the back board on the other side, the other side of the back board being connected with the left board;

the case body also having two door boards loosely and rotatably connected by hinges to the front board and the left board;

the upper cover and bottom board having slot-type interior hems corresponding to the door boards.

13. A tool cabinet comprising:

an upper cover;

a bottom board;

a case body comprised of four loosely integrated case boards including, a front board, a back board, a right board and a left board connected with each other in turn by hinges, the right board, respectively, being connected with the front board on one side and with the back board on the other side, the other side of the back board being connected with the left board;

the case body also having two door boards loosely and rotatably connected by hinges to the front board and the left board;

L-type transverse strengthening ribs set on the front board, the back board, the left board and the right board providing grip blocks; and a shelf is set on the grip blocks.

14. A tool cabinet comprising:

an upper cover;

a bottom board;

L-type keeper frames set on the upper cover and bottom board;

a case body comprised of four loosely integrated case boards including, a front board, a back board, a right board and a left board connected with each other in turn by hinges, the right board, respectively, being connected with the front board on one side and with the back board on the other side, the other side of the back board being connected with the left board;

the case body also having two door boards loosely and rotatably connected by hinges to the front board and the left board;

an L-type upright column having an upper end and a lower end loosely connected, respectively, with the upper cover and the bottom board by being set in the L-type keeper frames, the column being set at the juncture of the two door boards of the case body; and a shelf inside the tool cabinet the shelf being reticular.

* * * * *